US010859349B1

(12) United States Patent
Liu

(10) Patent No.: US 10,859,349 B1
(45) Date of Patent: Dec. 8, 2020

(54) MICRO SWITCH ADJUSTMENT STRUCTURE OF A THROWING TRAP

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 16/718,440

(22) Filed: Dec. 18, 2019

(51) Int. Cl.
*F41J 9/18* (2006.01)
*H01H 1/00* (2006.01)

(52) U.S. Cl.
CPC ..... *F41J 9/18* (2013.01); *H01H 1/0036* (2013.01)

(58) Field of Classification Search
CPC ..... F41J 9/18; F41J 9/20; F41J 9/32; A63B 69/408
USPC ..... 124/1, 6, 7, 8, 9
See application file for complete search history.

(56) References Cited

U.S. PATENT DOCUMENTS 1,376,825 A * 5/1921 Napier ..... F41J 9/18 124/8
2,184,389 A * 12/1939 Loomis ..... F41J 9/18 124/33
3,130,717 A * 4/1964 Moinil ..... F41J 9/18 124/1
3,421,491 A * 1/1969 Brown ..... F41J 9/32 124/9
3,878,828 A * 4/1975 Francesco ..... A63B 69/408 124/16
4,014,310 A * 3/1977 Laporte ..... F41J 9/18 124/6
4,077,384 A * 3/1978 Montefeltro R. ..... F41J 9/16 124/1
4,086,903 A * 5/1978 Scott ..... A63B 69/406 124/78
4,168,695 A * 9/1979 Haller ..... A63B 69/408 124/16
4,300,520 A * 11/1981 Laporte ..... F41J 9/32 124/9
4,747,390 A * 5/1988 Storm ..... F41J 9/30 124/47
5,871,003 A * 2/1999 Laporte ..... F41J 9/18 124/8
6,173,705 B1 * 1/2001 DeWitt ..... B60R 9/08 124/1
6,176,229 B1 * 1/2001 Patenaude ..... F41B 3/04 124/8
7,066,365 B2 * 6/2006 Brown ..... B60R 9/06 224/401
8,899,216 B2 * 12/2014 Laporte ..... F41J 9/24 124/6
8,943,945 B1 * 2/2015 Collins ..... F41J 9/20 89/8
9,052,169 B2 * 6/2015 Laporte ..... F41J 9/24
(Continued)

*Primary Examiner* — Alexander R Niconovich
(74) *Attorney, Agent, or Firm* — Demian K. Jackson; Jackson IPG PLLC

(57) ABSTRACT

A micro switch adjustment structure for throwing trap includes an adjustment rod that has a connection hole located on one end thereof and coupled to a fastener that fastened a micro switch to an arched through hole on the front bottom side of the throwing trap body and an outer thread located on an opposite end thereof and inserted through a through hole on a rear bracket plate of the throwing trap body, and an adjustment knob having a screw hole threaded onto the outer thread of the adjustment rod such that the adjustment knob is rotatable clockwise or counter-clockwise to move the adjustment rod axially in adjusting the angular position of the micro switch.

1 Claim, 4 Drawing Sheets

(56) References Cited

U.S. PATENT DOCUMENTS

| | | | | |
|---|---|---|---|---|
| 9,945,644 | B2 * | 4/2018 | Fouques | F41J 9/30 |
| 10,458,760 | B1 * | 10/2019 | Liu | F41J 9/30 |
| 10,488,162 | B2 * | 11/2019 | Laporte | F41J 9/18 |
| 10,545,011 | B1 * | 1/2020 | Collins | F41J 9/24 |
| 2004/0049966 | A1 * | 3/2004 | Highfill | F41J 9/18<br>42/94 |
| 2013/0133636 | A1 * | 5/2013 | Rennert | F41J 9/18<br>124/80 |
| 2016/0327379 | A1 * | 11/2016 | Laporte | F41J 9/18 |
| 2018/0010893 | A1 * | 1/2018 | Fouques | F41J 9/24 |
| 2018/0017364 | A1 * | 1/2018 | Laporte | F41J 9/22 |
| 2018/0372459 | A1 * | 12/2018 | Laporte | F41J 9/18 |

* cited by examiner

MICRO SWITCH ADJUSTMENT STRUCTURE OF A THROWING TRAP

BACKGROUND AND SUMMARY OF THE INVENTION

The present invention relates to throwing traps, and more specifically, to a micro switch adjustment structure of a throwing trap, which facilitates adjustment of the angular position of the micro switch and ensures adjustment safety.

FIGS. 1 and 2 illustrate a micro switch adjustment structure of a throwing trap according to the prior art. As illustrated, a locating hole 61 and an arched through hole 62 are located on a front bottom side of the throwing trap body 6, a first screw 71 and a second screw 72 are respectively mounted in a first mounting hole 81 and a second mounting hole 82 on a micro switch 8 to fasten the micro switch 8 to the locating hole 61 and the arched through hole 62 and a locating block 70, allowing the lever 80 of the micro switch 8 to be contacted by a contact plate 601 that is fastened to a bottom side of a throwing spindle 60 of the throwing trap body 6, so that the micro switch 8 can turn off the throwing spindle drive motor 9. However, in order to adjust the stroke of the throwing spindle 60 to rotate the target throwing arm (not shown), the user need to go to the front side of the throwing trap body 6 and directly remove the second screw 72 and adjust the angular position of the micro switch 8 according to the desired stroke. However, if the user forgets to turn off the power first before adjustment, the user may be hit by the target throwing arm, causing an accident. Further, removing the second screw 72 needs to use a tool, such as screwdriver. This adjustment procedure is inconvenient.

The present invention has been accomplished under the circumstances in view. It is therefore the main object of the present invention to provide a micro switch adjustment structure of a throwing trap, which facilitates adjustment of the angular position of the micro switch without tools and improves adjustment safety.

DETAILED DESCRIPTION OF THE INVENTION

Figure 1:
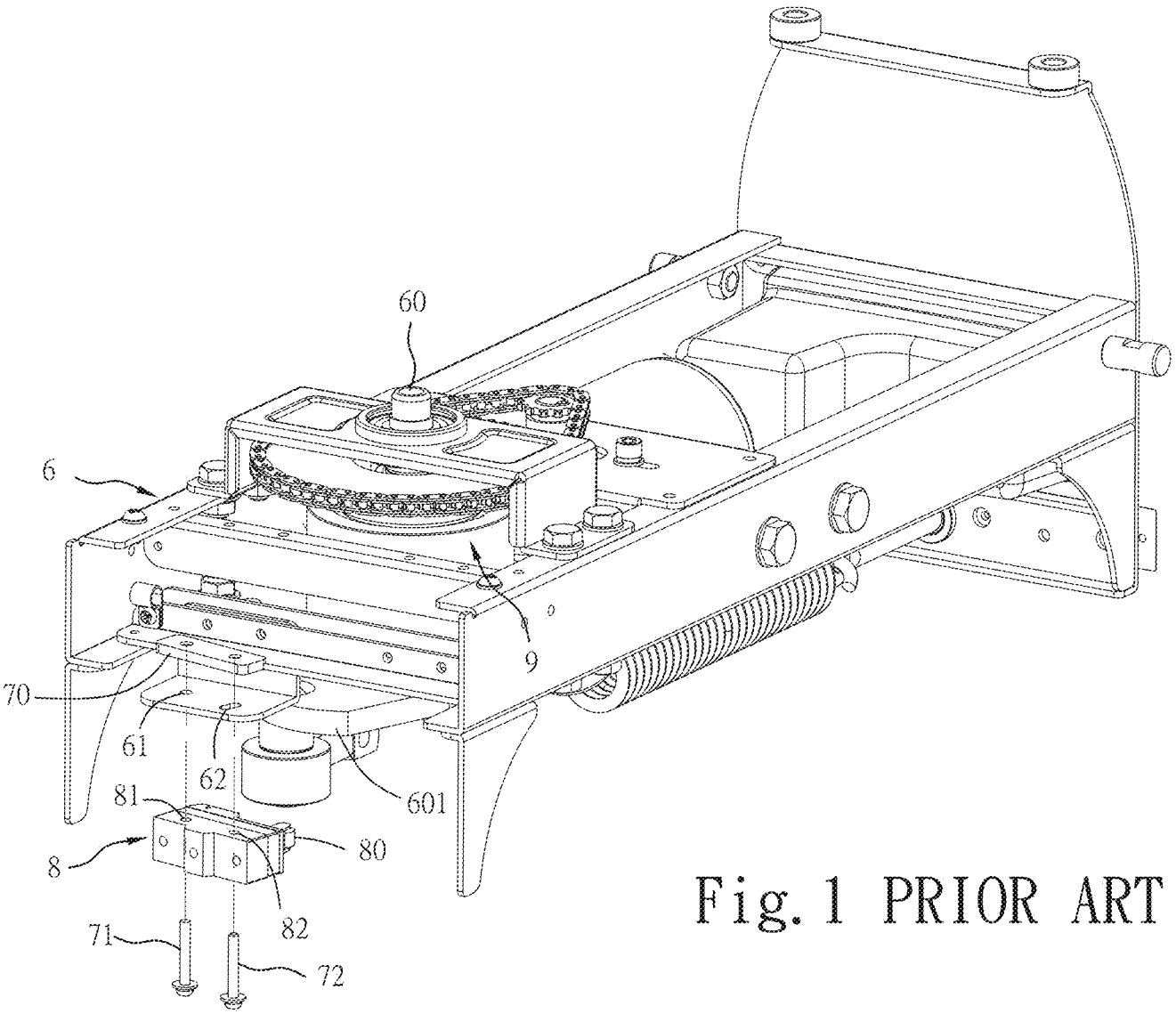
Fig. 1 PRIOR ART
FIG. 1 is an exploded view of a micro switch adjustment structure of a throwing trap according to the prior art.
Figure 2:
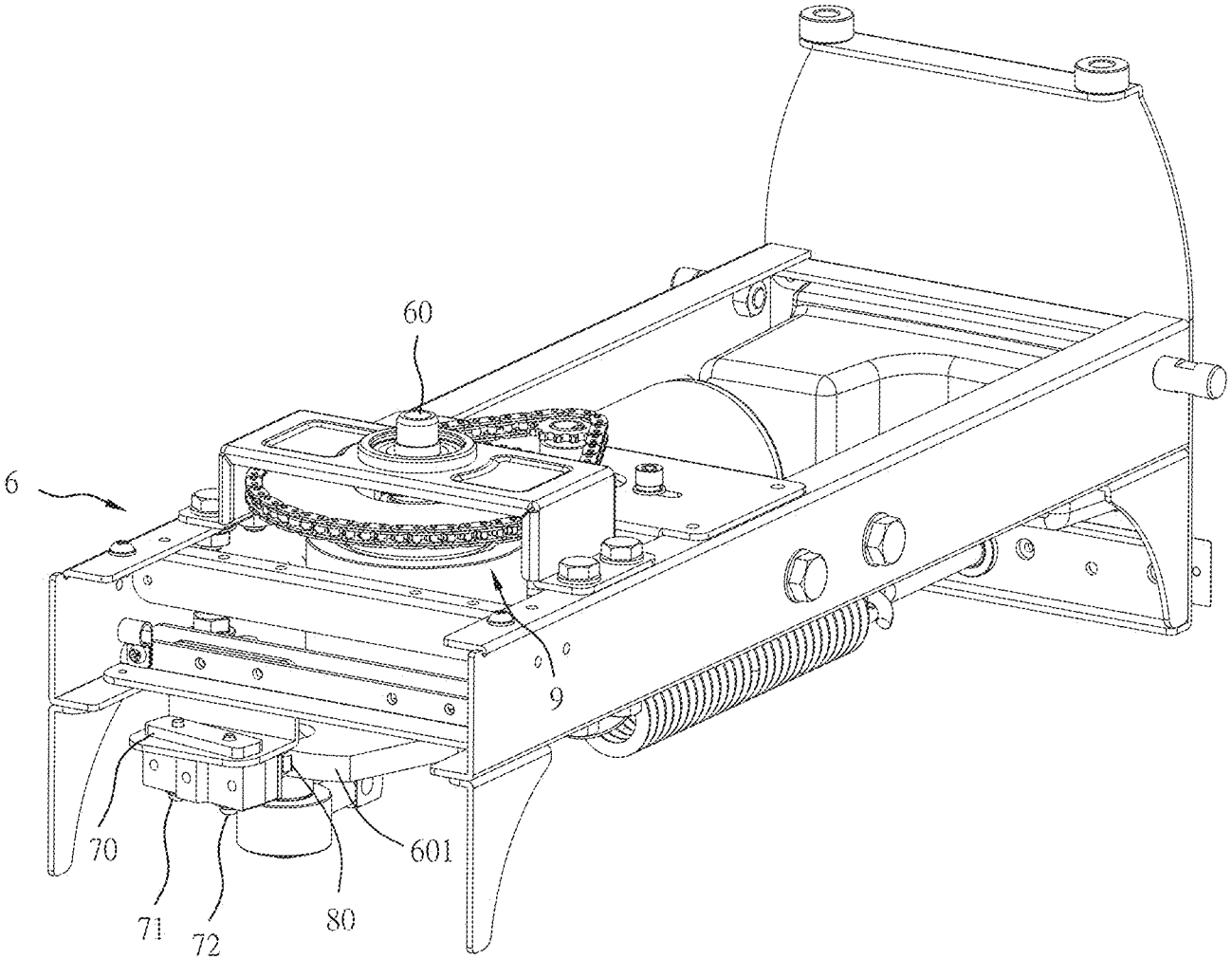
Fig. 2 PRIOR ART
FIG. 2 is an elevational view of the micro switch adjustment structure of the throwing trap according to the prior art.
Figure 3:
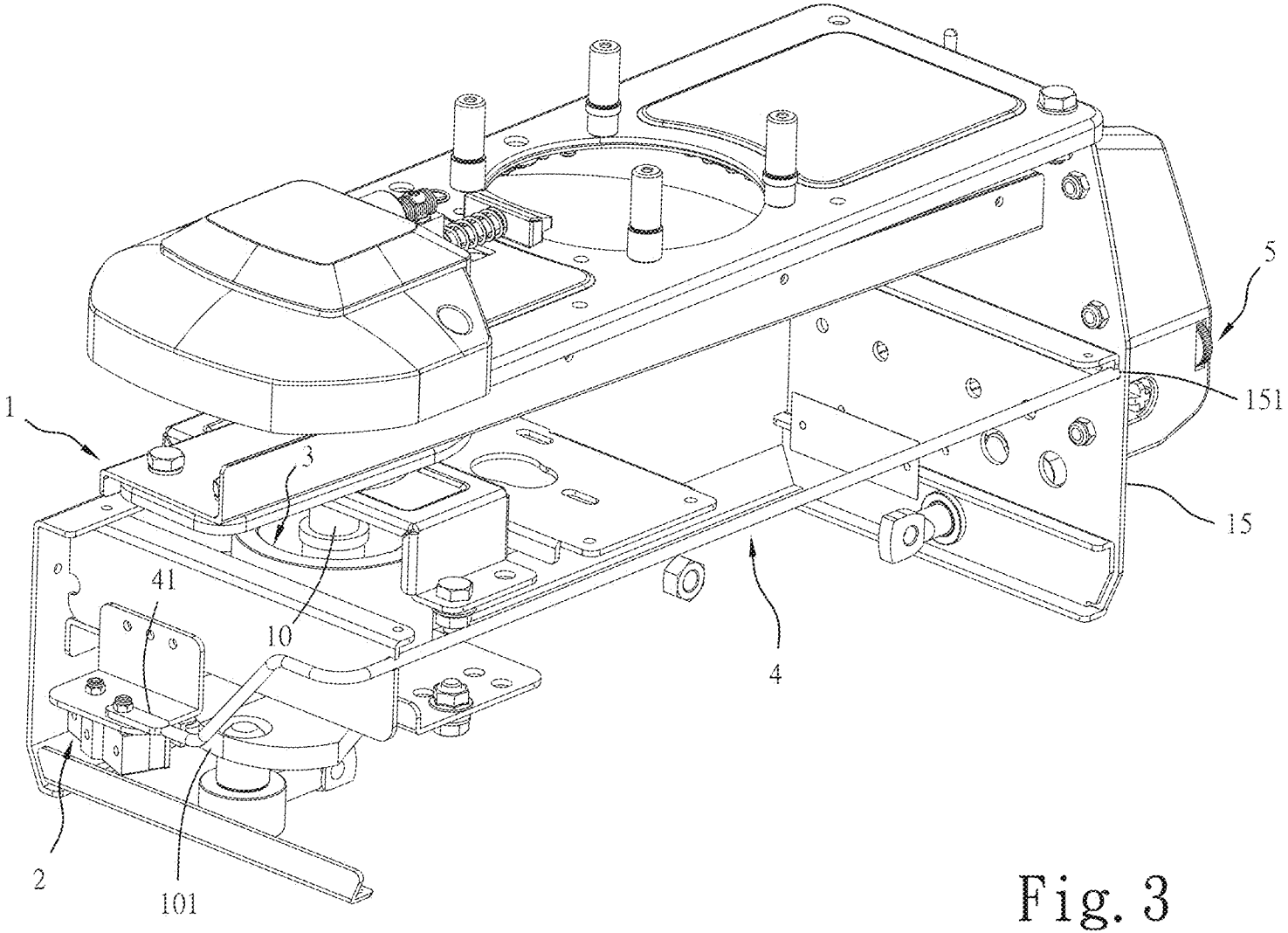
FIG. 3 is an elevational view of a micro switch adjustment structure of a throwing trap in accordance with the present invention.
Figure 4:
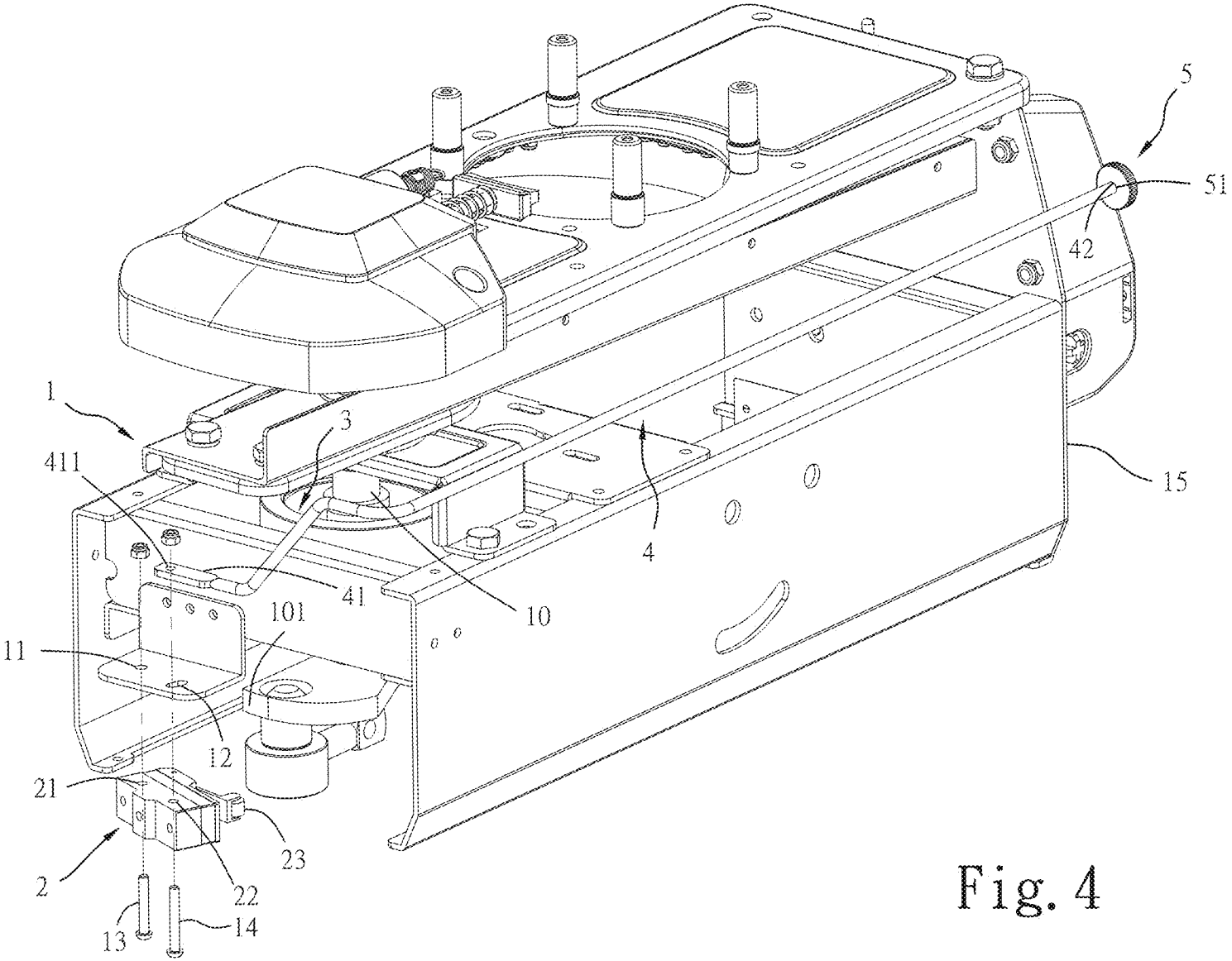
FIG. 4 is an exploded view of the micro switch adjustment structure of the throwing trap in accordance with the present invention.

Referring to FIGS. 3 and 4, a micro switch adjustment structure of a throwing trap comprises a locating hole 11 (see FIG. 4) and an arched through hole 12 located on a front bottom side of the throwing trap body 1, a first fastener 13 and a second fastener 14 respectively mounted in a first mounting hole 21 and a second mounting hole 22 on a micro switch 2 to fasten the micro switch 2 to the locating hole 11 and the arched through hole 12, allowing the lever 23 of the micro switch 2 to be contacted by a contact plate 101 that is fastened to a bottom side of a throwing spindle 10 of the throwing trap body 1, so that the micro switch 2 can turn off the throwing spindle drive motor 3.

The main features of the present invention are outlined hereinafter. One of the first fastener 13 and second fastener 14 fastened to one of the first mounting hole 21 and second mounting hole 22 of micro switch 2 is coupled to a connection hole 411 at one end of an adjustment rod 4. In the present preferred embodiment, the second fastener 14 fastened to the second mounting hole 22 of micro switch 2 is coupled to the connection hole 411 of the adjustment rod 4. The other end of the adjustment rod 4 is provided with an outer thread 42 that is inserted through a through hole 151 on a rear bracket plate 15 of the throwing trap body 1 and threaded into a screw hole 51 of an adjustment knob 5. By means of rotating the adjustment knob 5 clockwise or counter-clockwise to move the adjustment rod 4 axially, the angular position of the micro switch 2 is relatively adjusted to meet the needs of different uses. Since the user can directly rotate the adjustment knob 5 to adjust the angular position of the micro switch 2 from the rear side of the throwing trap body 1 without any tools, it can prevent the user from adjusting the micro switch within the rotation range of the target throwing arm on the front side of the throwing trap body 1, which relatively improves the safety of the micro switch adjustment.

In conclusion, the invention can be summarized to have the following effects:

1. The user can rotate the adjustment knob 5 to move the adjustment rod 4 axially, thereby adjusting the angular position of the micro switch 2 to meet the needs of different uses, and the user can directly rotate the adjustment knob 5 to adjust the angular position of the micro switch 2 from the rear side of the throwing trap body 1 without any tools.

2. It is convenient to adjust the angular position of the micro switch 2 and can prevent the user from adjusting the micro switch 2 within the rotation range of the target throwing arm on the front side of the throwing trap body 1, which relatively improves the safety of the micro switch adjustment.

What is claimed is:

1. A micro switch adjustment structure of a throwing trap comprising:

a throwing trap body, a locating hole and an arched through hole located on a front bottom side of said throwing trap body, a micro switch having a lever for switching and being provided with a first mounting hole and a second mounting hole, a first fastener and a second fastener respectively mounted in said first mounting hole and said second mounting hole to fasten said micro switch to said locating hole and said arched through hole of said throwing trap body for allowing said lever of said micro switch to be contacted by a contact plate being fastened to a bottom side of a throwing spindle of said throwing trap body, so that said micro switch is switchable to turn off a throwing spindle drive motor, and a micro switch adjustment assembly comprising an adjustment rod and an adjustment knob, said adjustment rod comprising a connection hole located on one end thereof and coupled to said second fastener and an outer thread located on an opposite end thereof and inserted through a through hole on a rear bracket plate of said throwing trap body, said adjustment knob comprising a screw hole threaded onto said outer thread of said adjustment rod such that said adjustment knob is rotatable clockwise or counter-clockwise to move said adjustment rod axially in adjusting an angular position of said micro switch.

* * * * *